US007715576B2

(12) United States Patent
Ribic

(10) Patent No.: US 7,715,576 B2
(45) Date of Patent: May 11, 2010

(54) METHOD FOR CONTROLLING A HEARING AID

(75) Inventor: Zlatan Ribic, Vienna (AT)

(73) Assignee: Dr. Ribic GmbH, Vienna (AT)

( * ) Notice: Subject to any disclaimer, the term of this patent is extended or adjusted under 35 U.S.C. 154(b) by 628 days.

(21) Appl. No.: 10/475,568

(22) PCT Filed: Apr. 18, 2002

(86) PCT No.: PCT/AT02/00114

§ 371 (c)(1),
(2), (4) Date: Mar. 29, 2004

(87) PCT Pub. No.: WO02/089520

PCT Pub. Date: Nov. 7, 2002

(65) Prior Publication Data

US 2004/0165731 A1 Aug. 26, 2004

(30) Foreign Application Priority Data

Apr. 27, 2001 (AT) ..... A 692/2001

(51) Int. Cl.
*H04R 25/00* (2006.01)

(52) U.S. Cl. ..... 381/312; 381/325

(58) Field of Classification Search ..... 381/312, 381/314, 315, 323

See application file for complete search history.

(56) References Cited

U.S. PATENT DOCUMENTS

| | | | | |
|---|---|---|---|---|
| 4,548,082 | A * | 10/1985 | Engebretson et al. | 381/328 |
| 4,947,432 | A * | 8/1990 | Topholm | 381/315 |
| 5,202,927 | A * | 4/1993 | Topholm | 381/315 |
| 5,479,522 | A | 12/1995 | Lindemann et al. | |
| 5,710,819 | A | 1/1998 | Topholm et al. | |
| 5,721,783 | A | 2/1998 | Anderson | |
| 5,757,932 | A | 5/1998 | Lindemann et al. | |
| 6,035,050 | A | 3/2000 | Weinfurtner et al. | |
| 6,167,138 | A * | 12/2000 | Shennib | 381/60 |
| 6,850,775 | B1 * | 2/2005 | Berg | 455/556.1 |
| 7,006,646 | B1 | 2/2006 | Baechler | |
| 7,239,711 | B1 | 7/2007 | Andersen et al. | |
| 2004/0013280 | A1 * | 1/2004 | Niederdrank | 381/315 |
| 2004/0234090 | A1 * | 11/2004 | Berg | 381/314 |

FOREIGN PATENT DOCUMENTS

| | | | |
|---|---|---|---|
| DE | 195 41 648 | | 5/1997 |
| DE | 196 00 234 | | 7/1997 |
| EP | 0 341 903 | | 11/1989 |
| EP | 0794687 | A1 | 9/1997 |
| EP | 0814634 | A1 | 12/1997 |
| JP | 10-229598 | | 8/1998 |
| WO | WO 98/16086 | | 4/1998 |
| WO | WO 98/20664 | | 5/1998 |
| WO | WO 00/60834 | | 10/2000 |
| WO | WO 00/64216 | | 10/2000 |
| WO | WO 02/28143 | A2 * | 4/2002 |

* cited by examiner

*Primary Examiner*—Walter F Briney, III
(74) *Attorney, Agent, or Firm*—Pandiscio & Pandiscio

(57) ABSTRACT

The invention relates to a method for controlling a hearing aid (1*a*, 1*b*) using a control unit (7), which is linked to the hearing aid (1*a*, 1*b*). The latter receives acoustic signals via a microphone (2*a*, 2*b*), amplifies said signals and outputs them by means of a loudspeaker (3*a*, 3*b*). In said hearing aid (1*a*, 1*b*) digital signals are processed according to a predetermined algorithm and data concerning the acoustic environment is created and forwarded to a control unit (7) via a communication interface (6*a*, 6*b*). To improve the quality and ease of operation, the data in the control unit (7) is analysed and an optimal algorithm is calculated, which is transmitted to the hearing aid (1*a*, 1*b*) via the communication interface (9).

8 Claims, No Drawings

METHOD FOR CONTROLLING A HEARING AID

The invention relates to a method for controlling a hearing aid using a control unit which is linked to the hearing aid which receives acoustic signals via a microphone, amplifies said signals and outputs them by means of a loudspeaker, with digital signal processing occurring within the hearing aid according to a predetermined algorithm and with the data concerning the acoustic environment being created and forwarded to a control unit via a communication interface, and to a communication system with a hearing aid and a control unit.

Hearing aids have been improved substantially in the past years by the introduction of digital signal processing. The difficulty still remains, however, to adjust the hearing aid to various ambient situations. A further problem is to enable the user of a hearing aid an optimal use of phones or the like. A further consistent problem is that the users of hearing aids are still stigmatised and thus many persons with minor hearing losses wear hearing aids either not at all or only temporarily.

A communication system is known from U.S. Pat. No. 5,721,783 in which an apparatus is inserted into the ear of a person, which apparatus comprises a microphone, a communication interface and a loudspeaker. These device is in connection via said communication interface with an external unit in which signal processing is performed. This means that the signal received by the microphone is sent to the external unit, is processed there and is sent back again to the device worn in the ear in order to be output acoustically via the loudspeaker. The external unit can also contain a mobile phone. The disadvantage of such a device is that a function as a hearing aid is only given in cases when there is a correct connection between the device in the ear and the external device. A considerable amount of effort is necessary to ensure said permanent connection.

WO 00/60834 A shows a system in which a hearing aid is connected via an adapter with a mobile phone. This allows the user of a hearing aid in an improved fashion to use a mobile phone as long as the same offers a respective connection. The function of the hearing aid remains unchanged in all other respects.

A hearing aid is further known from WO 98/16086 A which can be remotely maintained via an acoustic coupler. An automatic adjustment to the various situations is not possible with such a device.

Moreover, various remote controls or programming devices for hearing aids are known (e.g. from EP 0 814 634 A for example). An automatic adjustment of a signal processing is also not possible in this case.

It is the object of the present invention to further improve such a method and a communication system consisting of one or two hearing aids and a control unit in such a way that an optimal adjustment of the signal processing to various situations and to the specific hearing loss is possible.

This is achieved in accordance with the invention in such a way that the data in the control unit are analyzed and an optimal algorithm is calculated which is sent via the communication interface to the hearing aid. It is provided in this respect that the hearing aid comprises the following components;

- a microphone;
- an amplifier which is configured to perform a digital signal processing according to a predetermined algorithm;
- a loudspeaker;
- a communication interface for bi-directional transfer of data;

and that the control device further consists of:

- an input device;
- a mobile phone;
- a communication interface for the bi-directional transfer of data;
- a module for analyzing data on the acoustic environment and for calculating an optimal algorithm for signal processing.

The advantage of the solution in accordance with the invention is that the hearing aid works autonomously as such and can offer basic services even without contact with the control unit. In normal operation this contact to the control unit will be in force, so that the advantages in accordance with the invention will come to bear. These are that the hearing sends data to the control unit on the respective acoustic situation and the relatively complex optimization of the signal processing is performed in the control device. Such an optimization can generally not always occur in the hearing aid (e.g. binaural signal processing when a stereo signal is evaluated or the like). Data are subsequently sent back by the control device to the hearing aid in order to choose the respective algorithm for the signal processing or to set the respective parameters. The data sent by the hearing aid to the control unit can be extracted data such as the average level in the case of different frequencies. It can also concern the audio signal itself. The relevant aspect is that the amplification of a signal processing is performed in the hearing aid itself.

In a particularly preferable embodiment of the invention it is provided that the control unit is configured so as to communicate via the mobile phone with a central computer system in order to renew the programs of the module for analyzing the data or the performance of audiometry. In this way the program in the control unit can always be brought to the latest level and calculations can be performed which for capacity reasons cannot be performed in the control unit.

The communication between the hearing aid and the control unit is performed especially appropriately according to the bluetooth standard, because the components required for this purpose can be purchased at low cost.

The use of the communication system is facilitated especially in such a way that preferably the hearing aid is integrated in a headset of a mobile phone.

It is provided for in a particularly preferred embodiment of the invention that the control unit itself, or supported by a central processing computer via the communication line (e.g. also via the internet), is configured to perform automatic audimetry. In the course of such an examination, various signals are played to the person to be examined which the person must register and evaluate.

The present invention further relates to a method for controlling a hearing aid via a control unit which is linked to the hearing aid, which receives acoustic signals via a microphone, amplifies said signals and outputs them by means of a loudspeaker, with digital signal processing occurring within the hearing aid according to a predetermined algorithm and with the data concerning the acoustic environment being created and forwarded to a control unit via a communication interface. It is provided for in accordance with the invention that the data are analyzed in the control unit and an optimal algorithm is calculated which is sent to the hearing aid via the communication interface. The communication between the hearing aid and the control unit can occur principally via a cable, but preferably communication is performed in a wireless fashion.

A further increase in the possibilities can be achieved in such a way that the control unit communicates with a central computer system in order to renew the calculation programs or load audiometry programs.

An adjustment of the hearing aid to a specific hearing loss of a user is preferably performed through the control unit itself or supported by the central processing computer. It is especially preferable in this connection when the control device performs an audiometric examination of the user (i.e. a so-called audiometry) via the hearing aid. This examination can be performed in two steps. Acoustic test patterns are offered to the person to be examined in a first step, which patterns must be evaluated by the same. This procedure is simplified when the feedback by the examined user occurs by voice input. Alternatively, such feedback could also be made via keyboard or a touchscreen. Known algorithms such as NAL, NAL-R, NALNL1, ½, Berger or the like can be used for performing the audiometry, as also newly developed algorithms which are specific to the hearing aid. Different algorithms can be used for the hearing aid function and for phone communication. This examination is continued until sufficient data has been collected in order to perform a first adjustment. A relevant advantage of this procedure is that the audiometry can be performed in the natural environment of the user and the own hearing aid is used for producing the sound patterns. In this way it is possible to eliminate any possible sources of errors and to achieve high quality standards.

In a second step it is possible to perform a fine-tuning. The specific ambient situation such as the own voice, music, noise from the street, party, etc. will be considered. This step can be performed repeatedly in order to ensure an up-to-date adjustment.

A special simplification of the operation can be achieved in such a way that instructions for the user to be examined are output by voice output via the hearing aid. As an alternative it is possible that instructions for the user to be examined are output via a display on the control unit. As a result of these properties it is easily possible to perform audiometry even without the help of a specialist, which leads to a considerable reduction in the amount of effort involved. It is thus possible to use various audiological tests such as threshold audiometry, MCL and UCL, balance tests and the like.

The invention is now explained in closer detail by reference to the embodiment shown in the drawing. The figure schematically shows a connection diagram of a solution in accordance with the invention.

Reference numerals 1*a* and 1*b* designate two hearing aids which are each equipped with a microphone 2*a*, 2*b* and a loudspeaker 3*a*, 3*b*. One amplifier 4*a*, 4*b* each is disposed in the interior of the hearing aids 1*a*, 1*b*, which amplifier can perform digital signal processing, as well as a transmitter/receiver 5*a*, 5*b* with a communication interface in the form of a bluetooth interface 6*a*, 6*b*. The hearing aids 1*a*, 1*b* communicate via said interface with a control unit 7 comprising a processor 8 for performing signal analyses, calculation of optimal signal processing algorithms and for performing audiometric examinations with or without the support of a central processing computer 13 (or internet sites) which is in connection with the hearing aids 1*a*, 1*b* via a bluetooth interface 9. Furthermore, a mobile phone 10 is integrated in the control unit 7 which allows a communication via a respective network. This integration can occur in such a way that the control unit 7 is received in a housing of a conventional mobile phone. A display is designated with reference numeral 11 and a keyboard with reference numeral 12.

The mobile phone can be used in the conventional manner, such that the microphone(s) built into the hearing aid and the built-in loudspeaker(s) are used. In this case the control unit controls the hearing aids in such a way that they are adjusted optimally to the situation. As a result, the hearing aid which is allocated to the ear which is not used for the phone can be switched to low amplification in order to provide ideal conditions.

Preferably, the mobile communicates with the user via the bluetooth connection and the hearing aid per se, especially in cases when the hearing aid is configured as a part of a so-called headset which has a microphone allocated to the user.

Hearing aids can be operated at a low hearing loss in such a way that they are not active in the normal case and are only activated for support during phone conversations or in special situations.

The invention claimed is:

1. A hearing aid system comprising a hearing aid and a control device removed from the hearing aid and linked to the hearing aid by a communications interface for autonomously controlling the hearing aid, the hearing aid comprising:

a microphone for receiving sound;

a speaker for imparting enhanced sound;

an amplifier in communication with the microphone and the speaker, the amplifier being configured to (i) perform digital signal processing in accordance with a predetermined algorithm in order to perform a processing operation on a first electrical signal derived from the sound received by the microphone to produce a second electrical signal which is output to the speaker, and (ii) derive data representing the acoustic environment external to the ear from sound received by the microphone; and a transmitter for transmitting the data representing the acoustic environment external to the ear via a first signal interface;

the control device comprising:

second signal interface in communication with the first signal interface and adapted to (i) receive the data representing the acoustic environment external to the ear, and (ii) transmit an optimal algorithm to the first signal interface; and a module for (i) analyzing the data representing the acoustic environment external to the ear, and (ii) calculating the optimal algorithm for digital signal processing, the control device being operable in a first mode to perform an audiometric process in cooperation with the hearing aid to adapt the hearing aid to the hearing loss of a specific user; and the control device being adapted to utilise feedback provided by the user relating to acoustic test signals output by the hearing aid as part of the audiometric process; and the control device being operable in a second mode to be responsive to the acoustic environment data transmitted thereto to derive the optimal algorithm based upon the data and to transmit the optimal algorithm to the hearing aid;

wherein the hearing aid is adapted to receive the optimal algorithm transmitted thereto by the control device and to perform said processing using the received optimal algorithm as the predetermined algorithm.

2. A hearing aid system according to claim 1 wherein instructions executed by the control device, and which enable the control device to perform the audiometric process in cooperation with the hearing aid, are stored within the control device.

3. The hearing aid system according to claim 2 and further comprising a computer in communication with the control device for at least one of signal analysis, algorithm processing, and audiometric examination.

4. The hearing aid in accordance with claim 1, wherein the control device comprises a mobile telephone.

5. A method of operating a hearing aid, the method comprising:

providing a hearing aid and a control device removed from the hearing aid and linked to the hearing aid by a communications interface for autonomously controlling the hearing aid, the hearing aid comprising:

a microphone for receiving sound;

a speaker for imparting enhanced sound;

an amplifier in communication with the microphone and the speaker, the amplifier being configured to (i) perform digital signal processing in accordance with a predetermined algorithm in order to perform a processing operation on a first electrical signal derived from the sound received by the microphone to produce a second electrical signal which is output to the speaker, and (ii) derive data representing the acoustic environment external to the ear from sound received by the microphone; and a transmitter for transmitting the data representing the acoustic environment external to the ear via a first signal interface;

the control device comprising:

a second signal interface in communication with the first signal interface and adapted to (i) receive the data representing the acoustic environment external to the ear, and (ii) transmit an optimal algorithm to the first signal interface; and a module for (i) analyzing the data representing the acoustic environment external to the ear, and (ii) calculating the optimal algorithm for digital signal processing, the control device being operable in a first mode to perform an the audiometric process in cooperation with the hearing aid to adapt the hearing aid to the hearing loss of a specific user; and the control device being adapted to utilise feedback provided by the user relating to acoustic test signals output by the hearing aid as part of the audiometric process; and the control device being operable in a second mode to be responsive to the acoustic environment data transmitted thereto to derive the optimal algorithm based upon the data and to transmit the optimal algorithm to the hearing aid;

wherein the hearing aid is adapted to receive the optimal algorithm transmitted thereto by the control device and to perform said processing using the optimal algorithm as the predetermined algorithm;

the method further comprising the steps of:

adjusting the hearing aid in an audiometric process to adapt the hearing aid to the hearing loss of the user;

deriving data representing the acoustic environment external to the ear from sound received by the microphone;

transmitting the data representing the acoustic environment external to the ear to the control unit;

analyzing the data representing the acoustic environment external to the ear and calculating the optimal algorithm for digital signal processing;

transmitting the optimal algorithm to the hearing aid; and performing digital signal processing using the received optimal algorithm as the predetermined algorithm.

6. A method according to claim 5 wherein instructions executed by the control device, and which enable the control device to perform the audiometric process in cooperation with the hearing aid, are stored within the control device.

7. A method according to claim 6 and further comprising providing a computer in communication with the control device for at least one of signal analysis, algorithm processing, and audiometric examination.

8. A method in accordance with claim 5, wherein the control device comprises a mobile telephone.

* * * * *

UNITED STATES PATENT AND TRADEMARK OFFICE

CERTIFICATE OF CORRECTION

PATENT NO. : 7,715,576 B2
APPLICATION NO. : 10/475568
DATED : May 11, 2010
INVENTOR(S) : Zlatan Ribic It is certified that error appears in the above-identified patent and that said Letters Patent is hereby corrected as shown below:

Delete Title Page and substitute the attached Title Page therefor.

In Drawing insert

-- Sheet 1 of 1 --.

Signed and Sealed this

Twenty-eighth Day of September, 2010

David J. Kappos

David J. Kappos
*Director of the United States Patent and Trademark Office*

(12) United States Patent
Ribic

(10) Patent No.: US 7,715,576 B2
(45) Date of Patent: May 11, 2010

(54) METHOD FOR CONTROLLING A HEARING AID

(75) Inventor: Zlatan Ribic, Vienna (AT)

(73) Assignee: Dr. Ribic GmbH, Vienna (AT)

( * ) Notice: Subject to any disclaimer, the term of this patent is extended or adjusted under 35 U.S.C. 154(b) by 628 days.

(21) Appl. No.: 10/475,568

(22) PCT Filed: Apr. 18, 2002

(86) PCT No.: PCT/AT02/00114

§ 371 (c)(1),
(2), (4) Date: Mar. 29, 2004

(87) PCT Pub. No.: WO02/089520

PCT Pub. Date: Nov. 7, 2002

(65) Prior Publication Data

US 2004/0165731 A1 Aug. 26, 2004

(30) Foreign Application Priority Data

Apr. 27, 2001 (AT) ..... A 692/2001

(51) Int. Cl.
*H04R 25/00* (2006.01)

(52) U.S. Cl. ..... 381/312; 381/325

(58) Field of Classification Search ..... 381/312, 381/314, 315, 323

See application file for complete search history.

(56) References Cited

U.S. PATENT DOCUMENTS

| | | | | |
|---|---|---|---|---|
| 4,548,082 | A * | 10/1985 | Engebretson et al. | 381/328 |
| 4,947,432 | A * | 8/1990 | Topholm | 381/315 |
| 5,202,927 | A * | 4/1993 | Topholm | 381/315 |
| 5,479,522 | A | 12/1995 | Lindemann et al. | |
| 5,710,819 | A | 1/1998 | Topholm et al. | |
| 5,721,783 | A | 2/1998 | Anderson | |
| 5,757,932 | A | 5/1998 | Lindemann et al. | |
| 6,035,050 | A | 3/2000 | Weinfurtner et al. | |
| 6,167,138 | A * | 12/2000 | Shennib | 381/60 |
| 6,850,775 | B1 * | 2/2005 | Berg | 455/556.1 |
| 7,006,646 | B1 | 2/2006 | Baechler | |
| 7,239,711 | B1 | 7/2007 | Andersen et al. | |
| 2004/0013280 | A1 * | 1/2004 | Niederdrank | 381/315 |
| 2004/0234090 | A1 * | 11/2004 | Berg | 381/314 |

FOREIGN PATENT DOCUMENTS

| | | | |
|---|---|---|---|
| DE | 195 41 648 | | 5/1997 |
| DE | 196 00 234 | | 7/1997 |
| EP | 0 341 903 | | 11/1989 |
| EP | 0794687 | A1 | 9/1997 |
| EP | 0814634 | A1 | 12/1997 |
| JP | 10-229598 | | 8/1998 |
| WO | WO 98/16086 | | 4/1998 |
| WO | WO 98/20664 | | 5/1998 |
| WO | WO 00/60834 | | 10/2000 |
| WO | WO 00/64216 | | 10/2000 |
| WO | WO 02/28143 | A2 * | 4/2002 |

* cited by examiner

*Primary Examiner*—Walter F Briney, III
(74) *Attorney, Agent, or Firm*—Pandiscio & Pandiscio

(57) ABSTRACT

The invention relates to a method for controlling a hearing aid (1*a*, 1*b*) using a control unit (7), which is linked to the hearing aid (1*a*, 1*b*). The latter receives acoustic signals via a microphone (2*a*, 2*b*), amplifies said signals and outputs them by means of a loudspeaker (3*a*, 3*b*). In said hearing aid (1*a*, 1*b*) digital signals are processed according to a predetermined algorithm and data concerning the acoustic environment is created and forwarded to a control unit (7) via a communication interface (6*a*, 6*b*). To improve the quality and ease of operation, the data in the control unit (7) is analysed and an optimal algorithm is calculated, which is transmitted to the hearing aid (1*a*, 1*b*) via the communication interface (9).

8 Claims, 1 Drawing Sheet

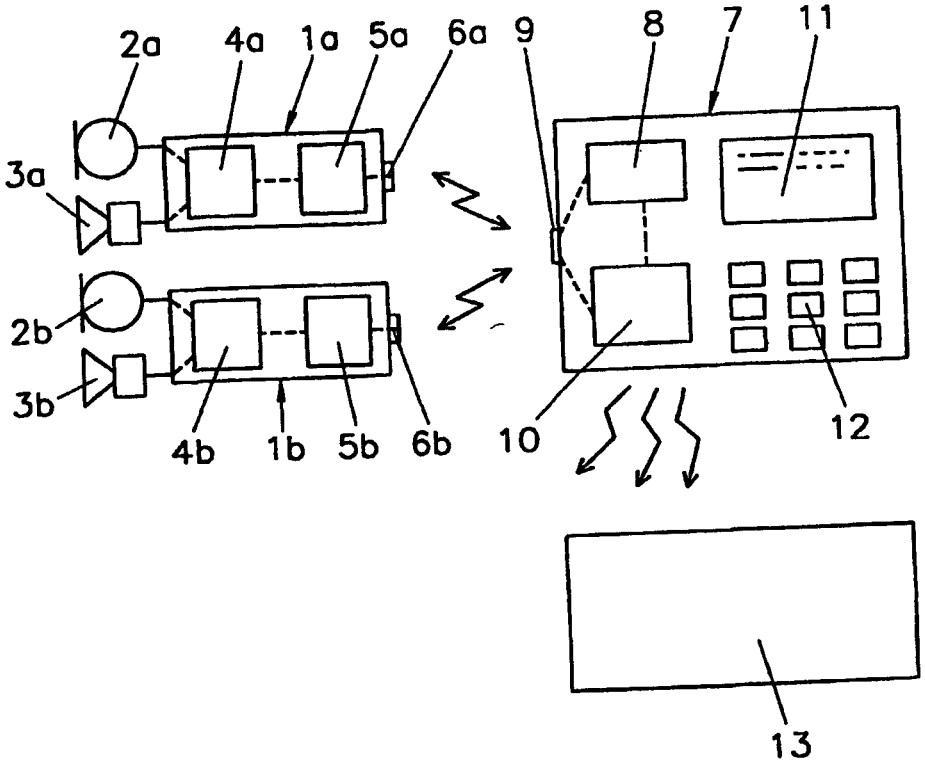
2a
4a
1a
5a
6a
9
8
7
11
3a
2b
3b
4b
1b
5b
6b
10
12
13